US006280048B1

(12) United States Patent
Luquire

(10) Patent No.: US 6,280,048 B1
(45) Date of Patent: Aug. 28, 2001

(54) PORTABLE MULTIPURPOSE VIEWING APPARATUS

(76) Inventor: L. Hanson Luquire, 1742 Radcliffe Rd., Montgomery, AL (US) 36106

( * ) Notice: Subject to any disclaimer, the term of this patent is extended or adjusted under 35 U.S.C. 154(b) by 0 days.

(21) Appl. No.: 09/295,986

(22) Filed: Apr. 21, 1999

Related U.S. Application Data

(63) Continuation-in-part of application No. 08/738,623, filed on Oct. 29, 1996, which is a continuation-in-part of application No. 08/399,435, filed on Mar. 7, 1995, now Pat. No. 5,570,275.

(51) Int. Cl.[7] ..... A47F 11/10

(52) U.S. Cl. ..... 362/125; 362/109; 362/135; 362/138

(58) Field of Search ..... 362/99, 109, 154, 362/125, 135, 138, 139, 200, 253, 268, 331, 375; 40/152.2, 156, 124.1, 546

(56) References Cited

U.S. PATENT DOCUMENTS

| | | | | |
|---|---|---|---|---|
| 2,000,537 | | 5/1935 | Ransom | 362/133 |
| 3,247,757 | | 4/1966 | Callaghan | 359/801 |
| 4,236,192 | | 11/1980 | Duggan | 362/133 |
| 4,942,685 | * | 7/1990 | Lin | 40/152.2 |
| 5,041,954 | * | 8/1991 | Forrest, Jr. | 362/234 |
| 5,111,366 | | 5/1992 | Rife et al. | 362/31 |
| 5,180,222 | | 1/1993 | Robinson | 362/125 |
| 5,247,745 | | 9/1993 | Valentino | 706/25 |
| 5,371,656 | | 12/1994 | Iorfida | 362/31 |

* cited by examiner

*Primary Examiner*—Thomas M. Sember
*Assistant Examiner*—Ismael Negron
(74) *Attorney, Agent, or Firm*—Dean W. Russell; Kilpatrick Stockton LLP

(57) ABSTRACT

A device for illuminating and magnifying printed cards for viewing. A body of the device has a hollow central region with hollow, opposed sides. At least one pair of slots near a floor of the hollow central region receives at least one printed card, with a magnifying lens mounted in an upper region of the hollow central region. A separate enclosure having an illumination bulb mounted therein is provided in one of the hollow sides, with batteries mounted in another hollow side. An opening in the enclosure passes light across the central region, providing indirect illumination of the card.

18 Claims, 10 Drawing Sheets

PORTABLE MULTIPURPOSE VIEWING APPARATUS

CROSS-REFERENCE TO RELATED APPLICATIONS

This application is a continuation in part of co-pending U.S. patent application Ser. No. 08/738,623, filed Oct. 29, 1996, entitled "Portable Multipurpose Viewing Apparatus," which is a continuation in part of U.S. patent application Ser. No. 08/399,435 (now U.S. Pat. No. 5,570,275), filed Mar. 7, 1995, entitled "Sports Card Viewing Apparatus."

FIELD OF THE INVENTION

This invention relates to illuminating viewing devices, and particularly to apparatus adapted to view diverse objects such as documentary sports cards, coins, insects, or the like in an enclosure where the objects are illuminated and magnified for viewing.

BACKGROUND OF THE INVENTION

Collectible documentary sports cards enjoy considerable popularity, and are collected by both adults and children. These cards are constructed of relatively stiff paper, plastic, or combinations thereof, and are available in a standardized size of 3.5 inches by 2.5 inches. Typically, a glossy or semi-glossy picture of an athlete is printed on one side of the card in either a landscape or portrait orientation, and documentary information and statistics about the athlete is printed on the other side.

As these cards are rather small, the pictures and documentary information thereon may sometimes be difficult to visualize and read. Additionally, the visual impact of a picture, particularly a picture depicting an athlete in action, is reduced due to the diminutive size of the card. Also, as some of these cards are quite rare, and thus valuable to collectors, determination of condition of these rare cards is important, and generally requires close scrutiny with a magnifying glass.

While Applicant is unaware of any particular device for viewing sports cards, devices of prior art which are believed to be most pertinent to the instant invention include patent references U.S. Pat. Nos. 5,041,954 to Forrest, filed Aug. 20, 1991, 4,236,192 to Duggan, filed Nov. 25, 1980, and 2,000,537 to Ransom, filed Aug. 15, 1932.

With respect to the reference of Forrest, an identification card inspection device is disclosed for examining identification cards, such as a driving license. This device consists of an enclosure, with a pair of transparent glass plates positioned at one end of the enclosure. These glass plates are oriented in spaced relation so as to form a slot for receiving a single identification card therebetween. A transparent window, which may include a magnifying lens, is positioned in an opposite end of the enclosure, the window being angularly positioned with respect to a plane of the slot between the plates so as to reduce glare from the transparent plates and identification card. Illumination lights are mounted in the enclosure in front of and to each side of the transparent plates for directly illuminating the identification card. A lip is positioned between each of the lights and the window for blocking direct light from the bulb from impinging upon eyes of the viewer.

Problems inherent with the device of Forrest are that the illuminating lights, being in the enclosure in front of the identification card and plates, create glare on the transparent plates and the identification card. In an effort to reduce this glare, the plates that hold the card and the viewing window are angularly displaced with respect to each other. Where the viewing window includes a magnification lens, this angular displacement causes optical distortion of the viewed image. Additionally, there is no teaching or suggestion that the slot for receiving the identification card is sized so that more than one card may be placed in the device. Further, since the length and breadth of the slot is sized to receive identification cards of various sizes, cards not closely sized to the slot are likely to shift therein, which may necessitate repositioning the card within the slot. Further yet, there is no teaching in Forrest of powering the lights thereof from a self-contained source of electrical power.

The reference of Duggan teaches a cabinet assembly for receiving a specimen for examination. The cabinet portion is constructed having a hood, with a lower rectilinear skirt, and an upper portion constructed in the shape of a truncated pyramid. A camera mount is provided in the truncated region of the upper portion for mounting a camera to the cabinet in order to record an image of the specimen. Illumination bulbs for providing light of a variety of wavelengths are mounted to interior sloping sides of the upper pyramidal region of the hood, directing light downward to illuminate the specimen from above. Additionally, a backlight source of illumination may be mounted to the bottom of the cabinet for illuminating the specimen from below.

The device of Duggan is a rather large device adapted for photographic inspection of a variety of objects, with no teaching of any means to hold an object to be examined in any particular orientation. Also, and as with the device of Forrest, light is directed onto the object to be examined from a point above the object, causing glare. Further, there is no teaching in Duggan of using a self-contained electrical source to power the illumination lights.

Ransom teaches a cabinet for receiving a sheet of printed material on a lower surface thereof for examination to determine uniformity of the print. A plurality of illumination bulbs are mounted at locations above the print, which bulbs being shielded from eyes of the user by shelves mounted to the interior of the cabinet.

As with the cabinet of Duggan, the cabinet of Ransom is a large cabinet adapted to receive a sheet of paper the size of newsprint. Additionally, the illumination bulbs are mounted above the printed material to be examined, again causing glare from the sheet of paper. Further, there is no teaching of powering the lights from a self-contained electrical source.

In addition, utility of a viewing device would be greatly enhanced if it were applicable to viewing other objects of interest, such as coins, stamps, insects or other objects. In this instance, the same viewer may be used by several individuals having different interests or hobbies.

Accordingly, it is an object of the invention to provide a hand-held viewing apparatus to enhance the enjoyment of viewing diverse objects such as sports cards, stamps, coins, or the like, the apparatus also allowing close scrutiny of the objects.

DETAILED DESCRIPTION OF THE DRAWINGS

Figure 2:
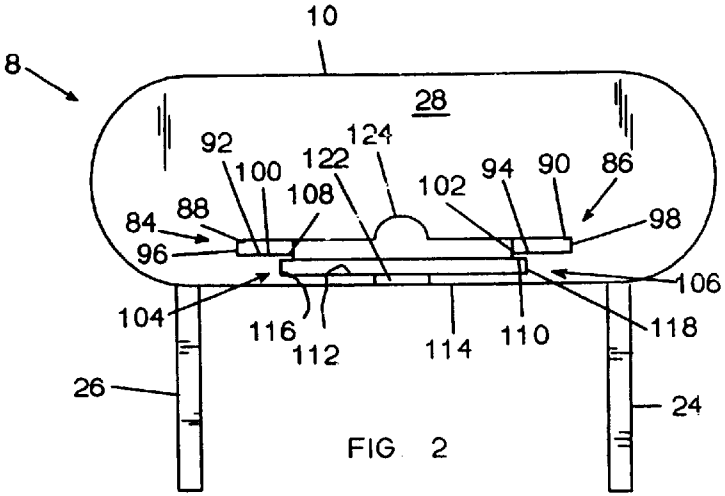
FIG. 2 is a view taken from an end of the instant invention wherein sports cards may be inserted.
Figure 3:
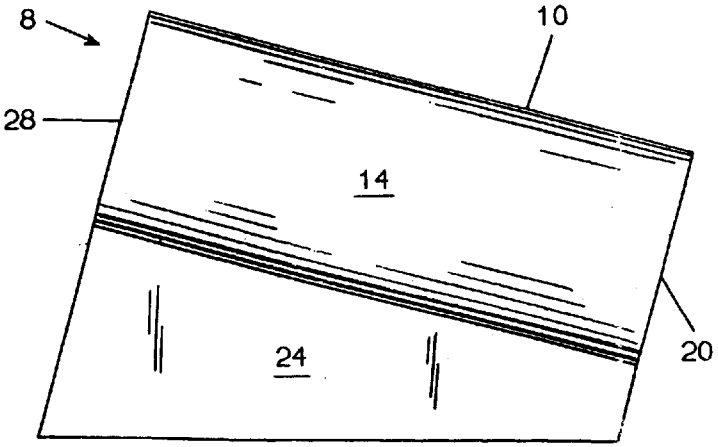
FIG. 3 is a side view of the instant invention.
Figure 1:
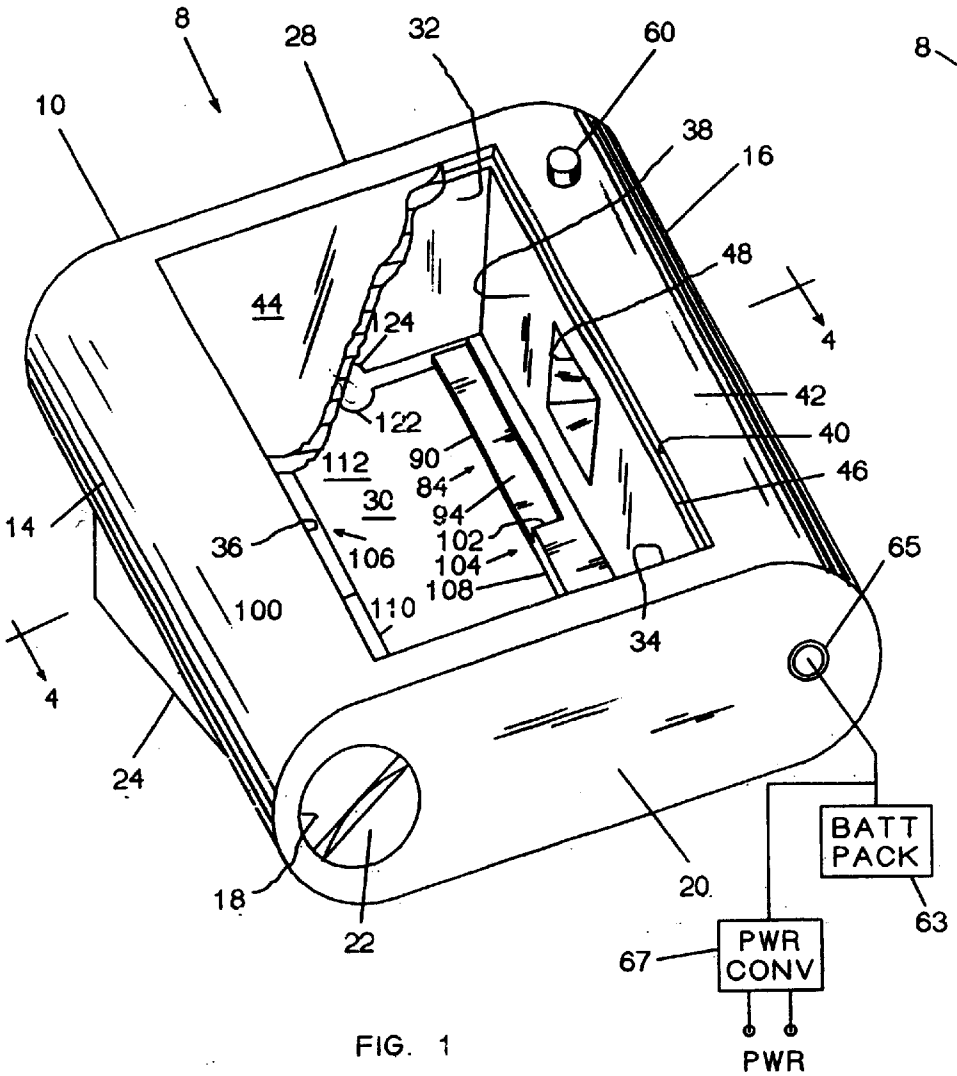
FIG. 1 is a perspective view taken from a point above and to one side of the instant invention, with a portion of a front lens thereof shown partially broken away.

Referring initially to FIGS. 1–3, one embodiment of a viewer 8 of the instant invention is shown. Here, a body 10 supports and contains components of the viewer, and is constructed having sides 14 and 16 of rounded, elongated contour. Sides 14 and 16 also provide grips for left and right hands, respectively, so that viewer 8 may be conveniently held by the user. A threaded opening 18 in wall 20 is closed by a threaded plug 22 so that batteries may be removed and replaced, as will be described. Where the viewer is used on a flat surface, such as a table, angled supports 24 and 26 orient viewer 8 generally normal to a line of sight from the viewer's eyes. Additionally, supports 24 and 26 elevate upper region 28 of the viewer, facilitating insertion and removal of the sports cards.

Figure 1A:
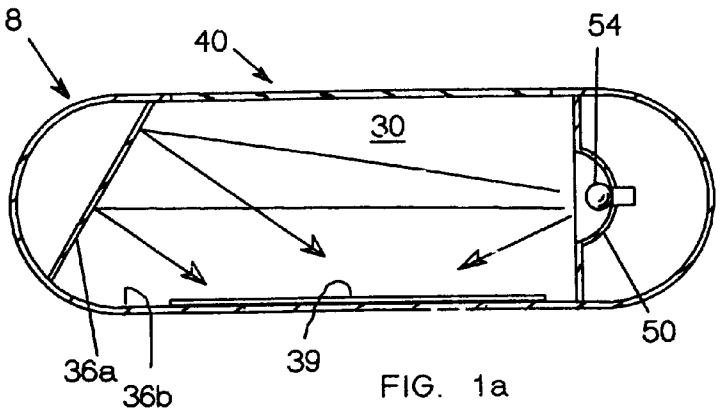
FIG. 1*a* is a cut-away view showing construction of one embodiment of an interior of the viewer.
Figure 1B:
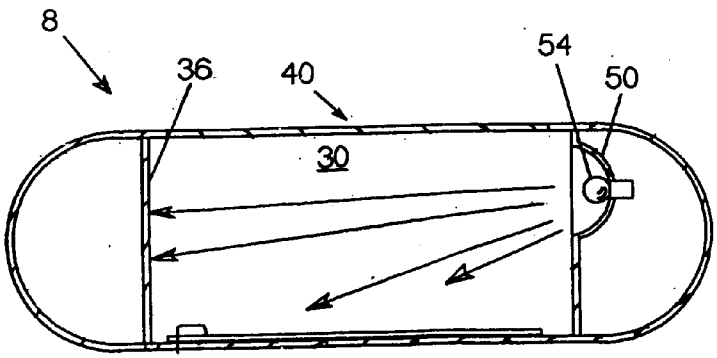
FIG. 1*b* is a cut-away view showing construction of another embodiment of an interior of the viewer.

Viewer 8 is provided with a generally hollow central region 30 (FIG. 1) defined by inner upper and lower walls 32 and 34, respectively, and inner left and right walls 36 and 38, respectively. In one embodiment, these walls may be provided with a generally reflective, light scattering coating, such as a flat white paint or the like, this coating diffusing and scattering light evenly throughout the interior or region 30. If desired, surfaces of these walls may be provided with an irregular, textured surface, for enhancing light scattering properties of the coating. Further, one or more of walls 32–38 may be angled as shown by wall 36*a* in FIG. 1*a* so as to reflect or scatter light toward an object such as a sports card 39. As such, light is scattered in region 30 to provide indirect, bright, yet diffused illumination of card 39, eliminating glare that otherwise would result from any direct illumination of the card or other object. In another embodiment as shown in FIG. 1*b,* walls 32–38 may be coated with a light absorbing substance or constructed to absorb light so as to darken the interior or region 30. This enhances appearance of an obliquely illuminated card or object 39 by eliminating any visual distractions that may be present within region 30. Also, a combination of light absorbing walls and light reflective walls may be employed, as where wall 36*a* (FIG. 1*a*) is reflective and floor 36*b* absorbs light.

An opening 40 (FIG. 1) in an upper surface 42 of viewer 8 communicates with central region 30, and provides an aperture through which a user views an object such as a sports card. Opening 40 may be provided with a magnifying lens, such as lens 44 (shown partially cut away) mounted therein. Lens 44 may be mounted in opening 40 as by means of a lip 46 to which lens 44 may be bonded or otherwise attached in order to magnify the image and printed material on the sports card. Where a magnifying lens is not used, a transparent plate or sheet of material may be placed in opening 40 for a user to look through, or opening 40 may be left open. In this instance, the plate or sheet may be interchangeable with other plates or sheets to impart special effects on viewed objects, such special effects including color and polarizing filters, etc.

As shown in FIGS. 1, 2, and 3, an opening 48 is provided in inner wall 38, which opening 48 communicating with an enclosure 50 which is separate and distinct from region 30. Enclosure 50 may be housed inside contoured side 16 of body 10, and supports a mounting fixture 52 for an illumination bulb 54. Bulb 54 may be a conventional bulb, such as a flashlight bulb, or a bulb designed to create special effects, such as a "black light", or ultraviolet, bulb. Interior walls of enclosure 50 may be configured having light scattering interior surfaces 78 as described above, for scattering light into central hollow region 30, or reflective in character for reflecting light into region 30. Also, the walls of enclosure 50 may be configured as shown in FIGS. 1*a* and 1*b* so as to direct light at an oblique angle onto a sports card or object or across hollow central region 30. As such, light is directed into region 30 to provide indirect or oblique bright, yet diffused, illumination of a sports card or other object, eliminating glare that otherwise would result from any direct or less oblique illumination of the object. Where an ultraviolet bulb is used, sides of the enclosure may be of a construction including a substance which fluoresces when exposed to ultraviolet light, thus providing light at visible wavelengths to illuminate portions of the card which do not fluoresce when exposed to ultraviolet light. Similarly, substances which can be made to glow in the dark may also be used in the construction of interior sides of the viewer so as to provide light to illuminate the card or object. Where a bulb is used, enclosure 50 may be sized and configured such that bulb 54 is completely housed within enclosure 50, permitting no direct or less oblique illumination in viewer 8 by light from bulb 54. As such, the card or object, for the most part, is indirectly illuminated by light from bulb 54, eliminating glare from any glossy or semi-glossy surfaces that may exist on the sports card or other object which otherwise would result from direct illumination by bulb 54. Additionally, such an enclosed mounting for the bulb shields the viewer from a direct view of the bulb, eliminating the need to provide a ledge or shelf for this purpose within region 30, which could block a portion of a view of the card or object. Also, the described illumination techniques allow lens 44 (FIG. 1) to be mounted in the same plane as the sports card or object, enabling optically accurate magnification thereof, while eliminating the necessity to mount the lens and object in angularly displaced relation in order to reduce glare. With this type of illumination, in combination with a magnifying lens and the light scattering or absorbing character of the interior of the enclosure, the image of the object is greatly enhanced, adding to the enjoyment of viewing sports cards and other objects.

While enclosure 50 (FIG. 4) is particularly disclosed as being mounted in side 16, enclosure 50 could be located in wall 20 or any other side of the viewer. In these embodiments, wall 20 may be constructed having an inner wall and an outer wall, these inner and outer walls being spaced apart in order to mount enclosure 50 therebetween. An opening such as opening 48 would be centrally located in the inner wall to permit light from the bulb to pass into region 30. Battery carrier 70 could then be mounted in either of sides 14, 16, or space permitting, in wall 20 along with enclosure 50. Also, enclosure 50 may be constructed integrally in a single wall, such as wall 20, of the viewer. Further, the viewer may be constructed so that the batteries and light source are located in sides of the hollow central region. Here, instead of discrete hollow sides, there would be a single enclosure housing the batteries, light source, and area for receiving the cards and objects. As in the other embodiments, the light bulb would be located so as to prevent a direct optical path between the bulb and eyes of the viewer. This may be done by simply eliminating walls 36, 38, and enclosure 50 (FIG. 4) and mounting fixture 52 directly to the interior of viewer 8 in a location so that the bulb is not directly viewable by the user.

Mounting fixture 52 is conventionally provided with terminals 56 and 58 for contacting terminal regions (not shown) of bulb 54. Bulb 54 in turn may be selectively energized, via a conventional pushbutton switch 60 (schematically illustrated), which may be mounted as shown to housing 10 (FIG. 1). Switch 60 is provided with a pair of terminals 62 and 64 (FIG. 4), with one of these terminals (62) coupled via a conductor 66 to the positive terminal 68 of a battery carrier 70. Carrier 70 would typically carry at least one battery, and typically two batteries, shown oriented in series relation, which batteries housed in contoured side 14 of body 10. Terminal 64 of switch 60 is conventionally coupled to one terminal (56) of mounting fixture 52, with the other terminal (58) of mounting fixture 52 coupled to negative terminal 72 of battery carrier 70 via a conductor 74. In this instance, conductors 66 and 74 would be of a length such that carrier 70 could be withdrawn from side 14 through opening 18. Also, carrier 70 may be constructed in the form of a cartridge provided with terminals that contact a matching set of terminals mounted in contoured side 14, the carrier being removable in order to change the batteries. Another battery mounting arrangement that may be employed is one wherein carrier 70 is permanently mounted in side 14, and accessible via a removable panel (not shown) in an upper, side, or bottom region of side region 14. Yet another mounting arrangement is one typically found in flashlights where the batteries are held in a tubular region and spring loaded so as to urge the batteries into electrical contact with each other and with electrical terminals at each end of the tubular region. Where an outside power source is contemplated, batteries or other power package may be carried in an external package, such as battery pack 63 (FIG. 1) coupled by an electrical power cord terminating with a plug for plugging into a mating plug 65 mounted to the viewer. The plug in the viewer would be connected to wires for coupling power to the bulb. Also a power conversion device 67 may be coupled to plug 65, as indicated by dashed lines, to power the bulb, which power converting devices may be a wall transformer to convert 115 VAC to a lower DC voltage or a power converter for converting vehicular DC voltage to a voltage suitable to power the bulb.

While a battery carrier for carrying the batteries is disclosed, it is to be appreciated that the batteries may be mounted in any other arrangement as would be convenient for manufacture. Additionally, conductors 66 and 74 may be routed in any manner as convenient for manufacturing and aesthetic considerations, as by molding a channel in the interior side of wall 34 for receiving conductors 66 and 74.

Figure 7:
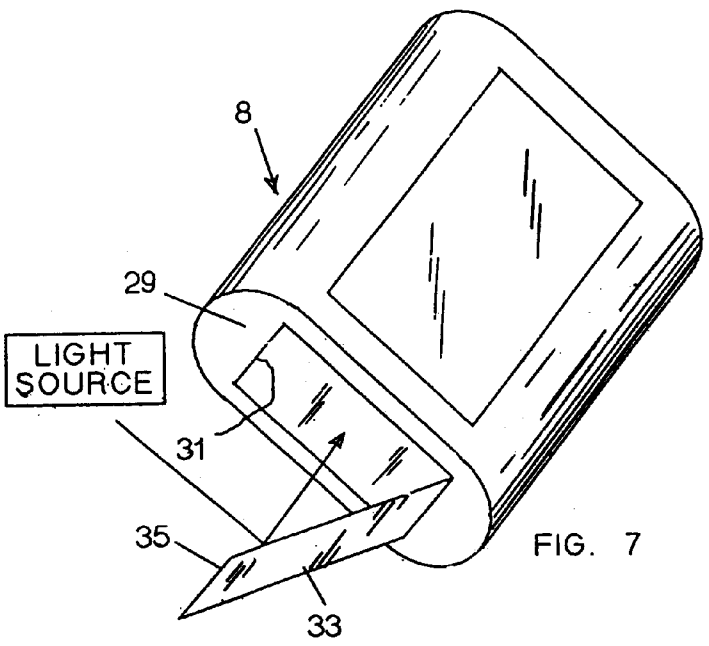
FIG. 7 is a perspective view of an embodiment of the invention wherein illumination is provided by an external source.
Figure 7A:
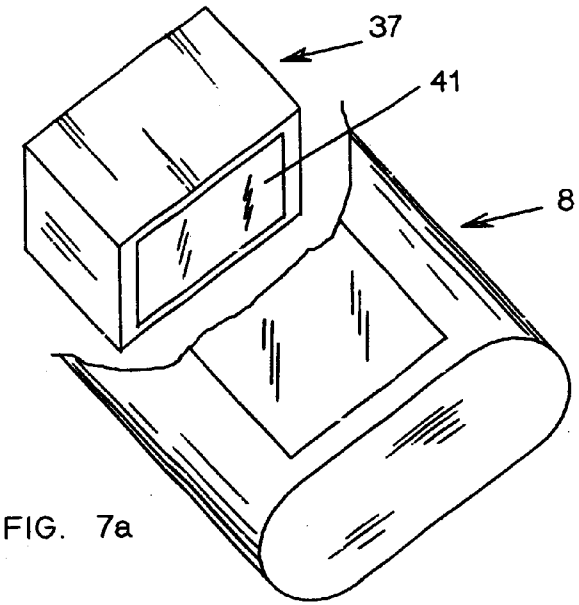
FIG. 7*a* is a view showing one use of an illumination device of the invention, with the viewer shown partially broken away.
Figure 4:
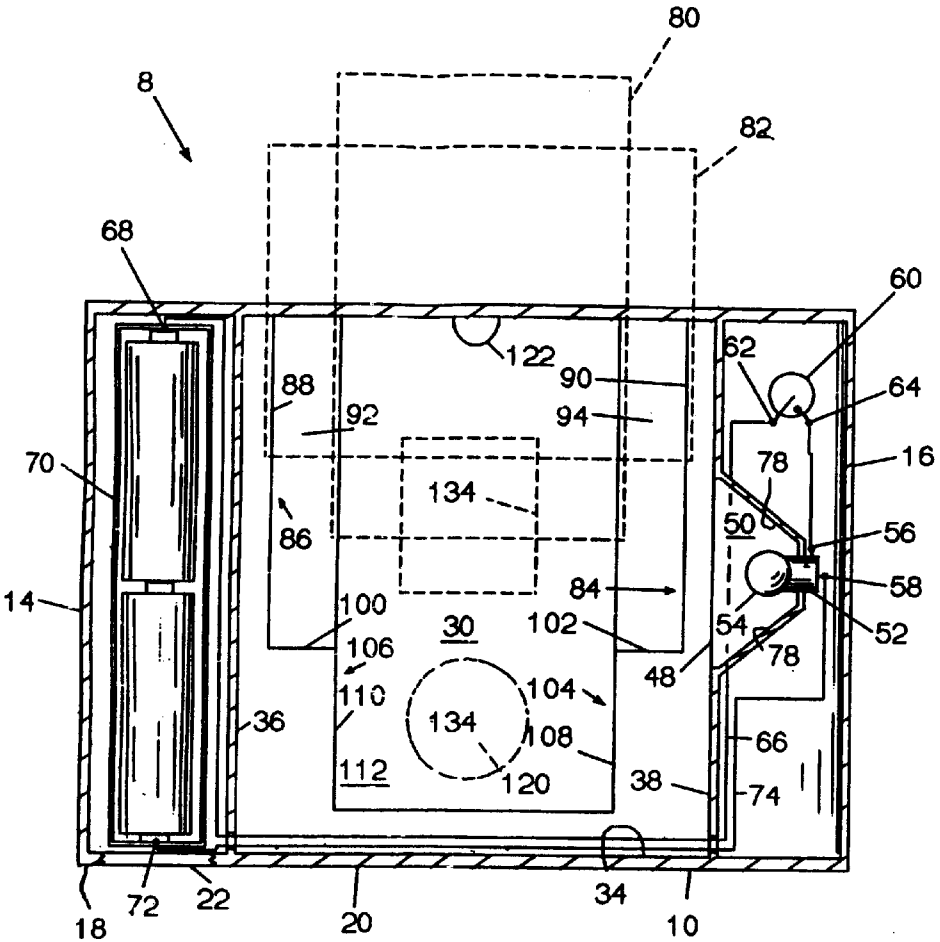
FIG. 4 is a sectional view taken along lines 4—4 of FIG. 1.
Figure 8:
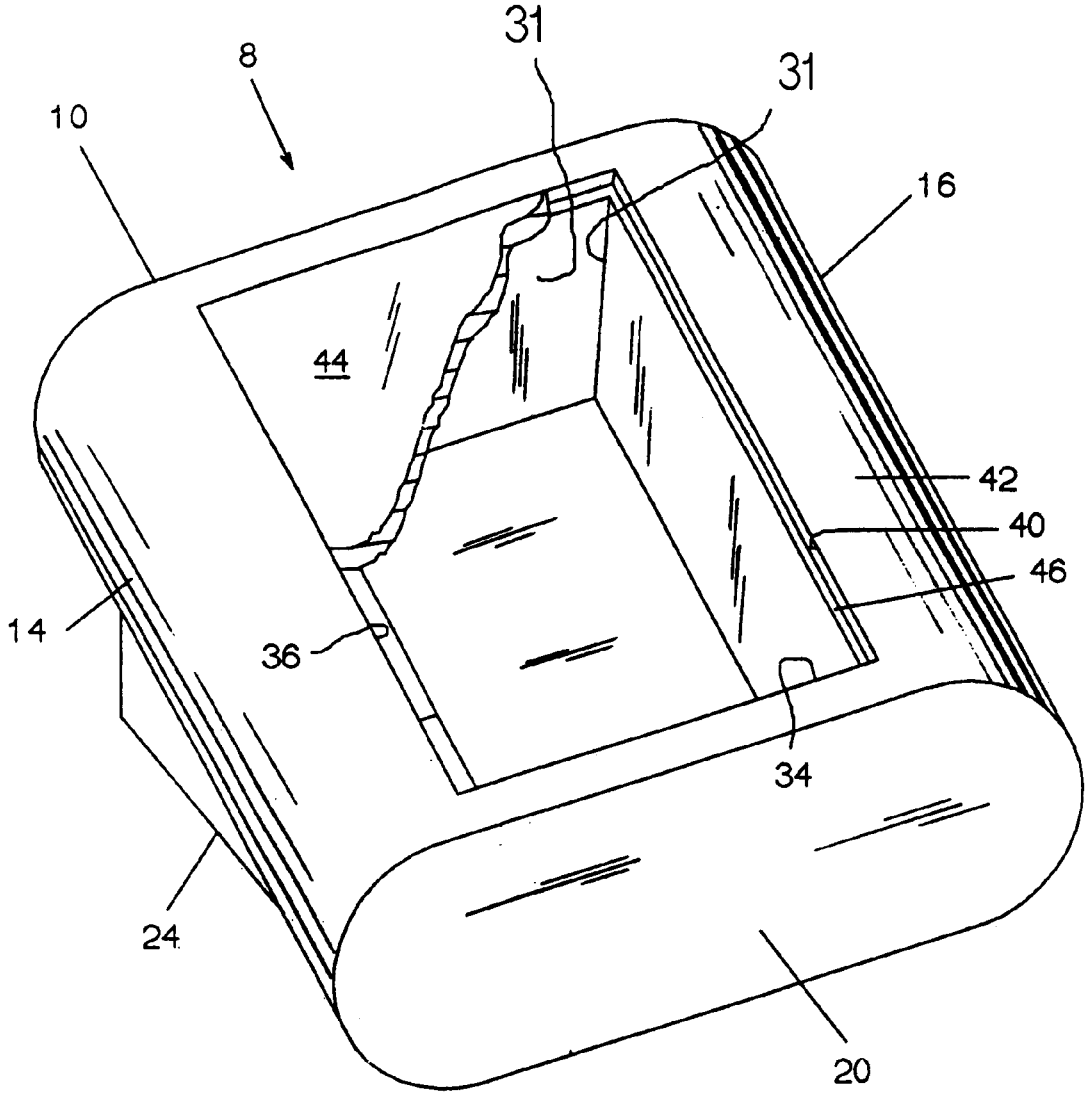
FIG. 8 is yet another view of an embodiment of the invention showing a simplified interior thereof.

In another embodiment of the sports card viewer, and referring to FIGS. 7, 7*a* and 8, one of the sides of viewer 8, such as side 29, may be provided with an opening 31 for allowing light from an external light source to illuminate objects in the interior of the viewer. In this embodiment, an illumination bulb may or may not be provided for illumination where an external light source is not available. Where it is contemplated that opening 31 be provided in a viewer having an internal light source, a panel 33 may be provided to cover opening 31 when the internal light source is used. Panel 33 may be configured with latches or catches so that it is completely removable from the viewer, or hinged or otherwise attachable to the viewer as shown in FIG. 7. Where the panel is hinged or attachable to the viewer, an interior surface 35 of panel 33 may be provided with a highly reflective surface so as to reflect light toward the interior of the viewer. Also, as shown in FIG. 7*a,* an external light source 37 may be provided for the viewer, the light source configured for providing light directly through opening 31. In this embodiment, the light source may be attachable directly to the viewer, as by catches or hook-and-loop tape, or placed adjacent to or against the viewer, with a light-emitting window or opening 41 in the light source communicating directly with opening 31 of the viewer. Further yet, opening 31 may be sized such that a card or other object may be placed in the viewer through opening 31, eliminating any need for slots through which a card or object is inserted.

Where the viewer is particularly designed for viewing sports cards, and as it is generally inconvenient to insert and remove a single card at a time in/from viewer 8, means may be provided so that a plurality of sports cards may be loaded into viewer 8 in both vertical and horizontal relation simultaneously, as shown in FIG. 4 by dashed line representations of partially inserted vertical and horizontal cards 80 and 82, respectively. Here, and referring additionally to FIGS. 1 and 2, a first pair of slots or grooves 84, 86 may be defined by upper lips 88, 90, and raised, narrow floors 92, 94. Lips 88, 90 and floors 92, 94, respectively, are in opposed, spaced relation with respect to each other, with spacing between the lips and floors being such that a selected number of cards, such as the number of cards in a commercially available packet of cards, may be inserted into slots 84, 86. Spacing between slots 84, 86 is defined by outer walls 96, 98 (FIG. 2), and is such as to closely accommodate the lengthwise dimension of cards 82 having a landscape view printed thereacross. Ridges 100, 102 positioned on floors 92, 94 provide an abutment against which cards having a landscape view rest, limiting their travel within region 30, which would otherwise cause difficulty in their removal.

For cards 80 having a portrait view printed across the width thereof, a second pair of opposed slots or grooves 104, 106 may be provided, these slots defined by lips 108, 110 and floor 112, floor 112 also forming a back wall 114 of viewer 8. As with slots 84, 86, spacing between lips 108, 110 and floor 112 is such as to accommodate the number of sports cards found in a commercially available packet thereof. The distance between slots 104, 106 is defined by outer walls 116, 118, and is such as to closely accommodate the width dimension of cards 80 having a portrait view printed thereon. A second ridge 120 (FIG. 4) may be provided as an abutment for cards inserted between slots 104, 106, or the cards may abut directly against an inner surface of wall 34. Notches 122, 124 are provided in floor 112 and wall 32, respectively, to provide clearance for fingers of the user, whose fingers may be inserted in notches 122, 124 to remove a top card adjacent lens 44, exposing the card beneath for viewing. In another embodiment, as shown in FIG. 8, a single, flat area for receiving cards in both landscape and portrait orientation may be provided on a floor of the viewer, the cards being inserted through an opening in one of the walls of the viewer, such as opening 31.

While viewer 8 is disclosed as having a back wall 114, it is to be noted that most of this wall may be omitted, or constructed so that it is removable, leaving opposed slots 104, 106 so that a packet of cards may be placed lengthwise between these slots. This embodiment would be useful where it is desired to place other flat articles, such as postage stamps or coins beneath body 10 for perusal of a magnified, illuminated image thereof. In this application, supports 24, 26 may be constructed having a rectangular configuration, or be adjustable or removable so that lens 44 of viewer 8 is in a like plane as a surface upon which the viewer and object being viewed rests. Additionally, this embodiment would allow cleaning of the inside surface of the lens, which otherwise would be completely enclosed within region 30. Further yet, by leaving the lower region substantially open as described, removal of the cards would be greatly facilitated.

Figure 5:
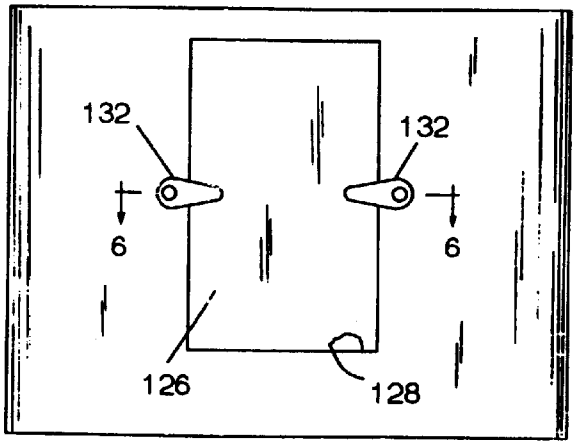
FIG. 5 is a view of a back region of the instant invention.
Figure 6:
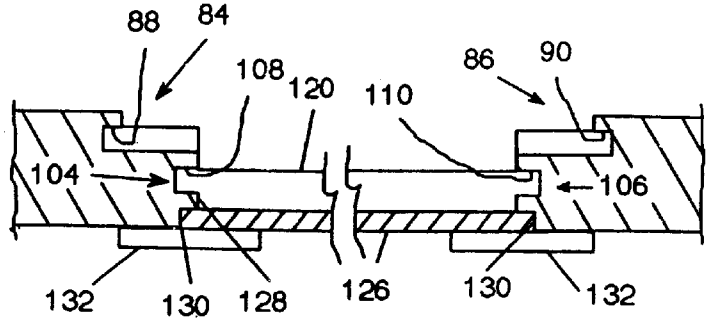
FIG. 6 is a sectional view taken along lines 6—6 of FIG. 5.

FIGS. 5 and 6 disclose an embodiment of the viewer as described above which is provided with a removable back. Here, by way of example, the back wall may be configured having a removable panel back 126, which panel 126 approximately sized to the dimensions of lips 108, 110, and ridge 120 (FIG. 4). With panel 126 removed, an opening 128 is exposed in the back of viewer 8, this opening being slightly smaller than a card inserted therein in lengthwise orientation. In this embodiment, edges of panel 126 (FIG. 6) may be fitted into grooves or recesses 130 adjacent opening 128, with panel 126 held in place by latches, such as rotatable latches 132. If desired, recesses 134 (dashed lines in FIG. 4) may be molded in the inner side of panel 126 for placing coins and stamps therein for examination. In another embodiment, flat plates generally the size of sports cards, such as cards 80, 82 may be provided for inserting into the viewer, these plates having recesses as shown by recesses 134 (FIG. 4) for holding coins, stamps, or the like. A transparent cover may be provided for covering objects placed in recesses 134, or the objects may be enclosed in a protective enclosure, as is commonly found with rare coins and insects such as butterflies.

While a particular design for a removable back portion is disclosed, other designs for a removable back may be utilized, such as one where the back panel and bordering area is provided with mating dovetail type sides, or flexible snaps and mating catches.

FIG. 7 illustrates a removable viewing hood 136 attached to viewer 8, as by hook and loop tape, or by catches constructed on lower edges 138 of hood 136 that engage openings in viewer 8 (not shown). Hood 136 would be used in high illumination conditions, such as outdoors, where hood 136 shields lens 44 and the interior of the viewer from extraneous external light. If desired, upper edges 140 of hood 136 may be configured so as to fit the face of a user in a similar manner as a diver's mask, facilitating viewing of the cards by virtually eliminating external light.

Figure 9:
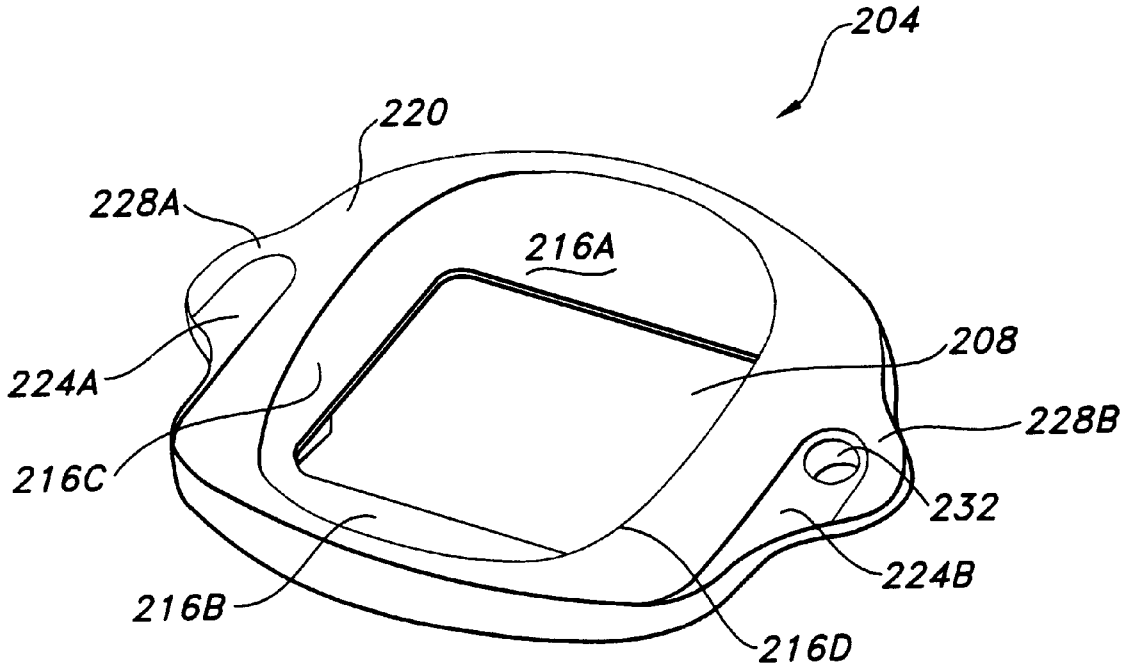
FIGS. 9–14 illustrate aspects of an alternate illumination device of the present invention.
Figure 10:
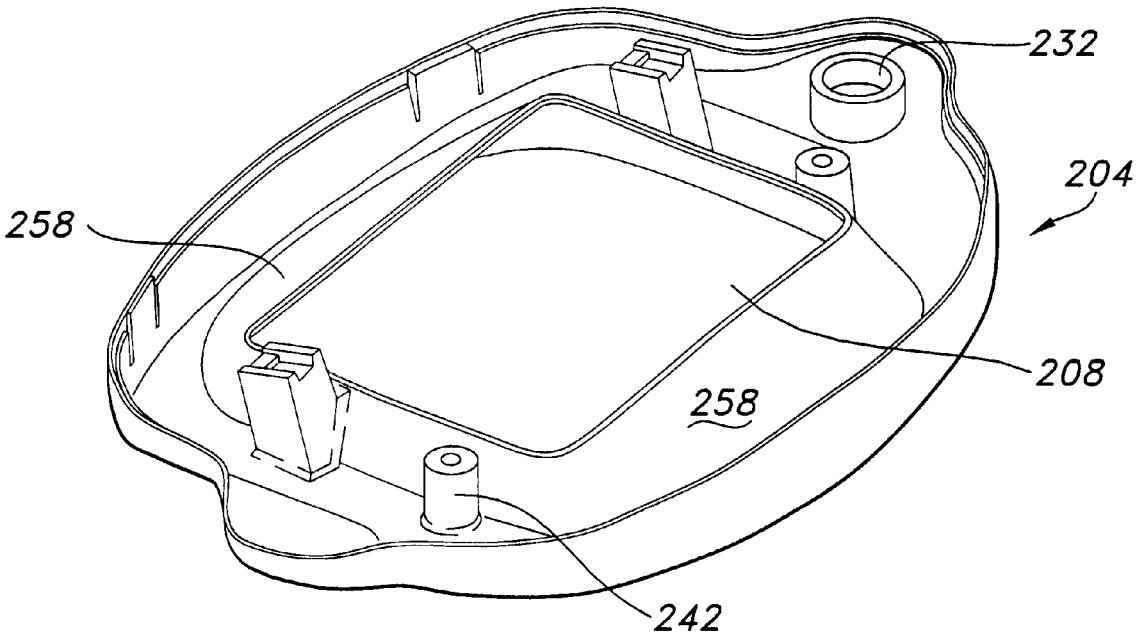

Illustrated in FIGS. 9–14 is an alternative illumination or viewing device 200 consistent with the invention. Device 200 may incorporate any or all features discussed previously in connection with viewer 8 or otherwise herein. As shown principally in FIGS. 9–11, however, device 200 may include upper portion 204, which in some embodiments may be molded of plastic or other suitable material. Upper portion 204 typically defines an opening 208 adapted for placement adjacent lens 212 (if present) so as not to obstruct viewing an item or object of interest. FIGS. 9–10 especially detail relatively central placement of opening 208 within upper portion 204, although such placement is not critical to proper functioning of device 200.

Figure 11:
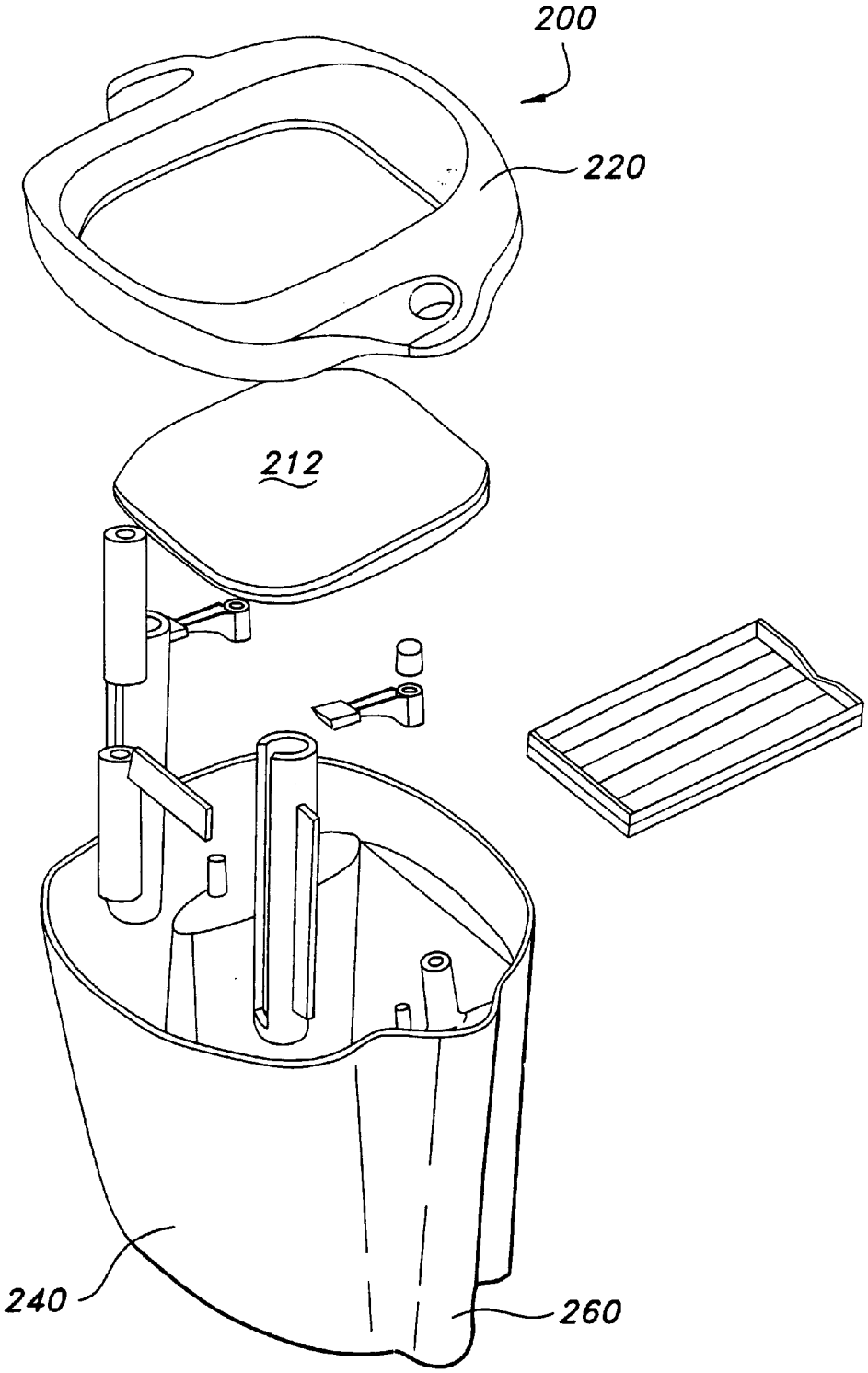

Nonetheless, as illustrated in FIGS. 9–11, opening 208 is planar and defined by walls 216A–D. If desired, each of walls 216A–D may slope outward from opening 208 as it approaches top surface 220 of upper portion 204, thus forming an angle greater than ninety degrees with the plane of opening 208. The sloped nature of walls 216A–D not only may avoid obstructing viewing of the item of interest, but additionally may more effectively focus the viewer's attention toward the object under examination, in some respects funneling the viewer's range of vision toward opening 208 and, if present, lens 212. If lens 212 is oversized (i.e. of greater length and width than the item of interest), moreover, its combination with sloped walls 216A–D may create a perception of greater size or clarity of view of the item regardless of whether lens 212 has conventional magnifying capabilities. Although in a preferred embodiment of device 200 opposed walls 216A–B have different slope than walls 216C–D, those skilled in the art will recognize such different slopes are not necessary for or required by the present invention.

Additionally illustrated in FIGS. 9 and 11 are contoured recesses 224A–B present in top surface 220. Such recesses 224A–B may facilitate a viewer holding device 200, effectively functioning as rests for the viewer's thumbs. Recesses 224A–B accordingly may be elongated and have respective rounded ends 228A–B, generically outlining the shape of a human thumb.

Figure 12:
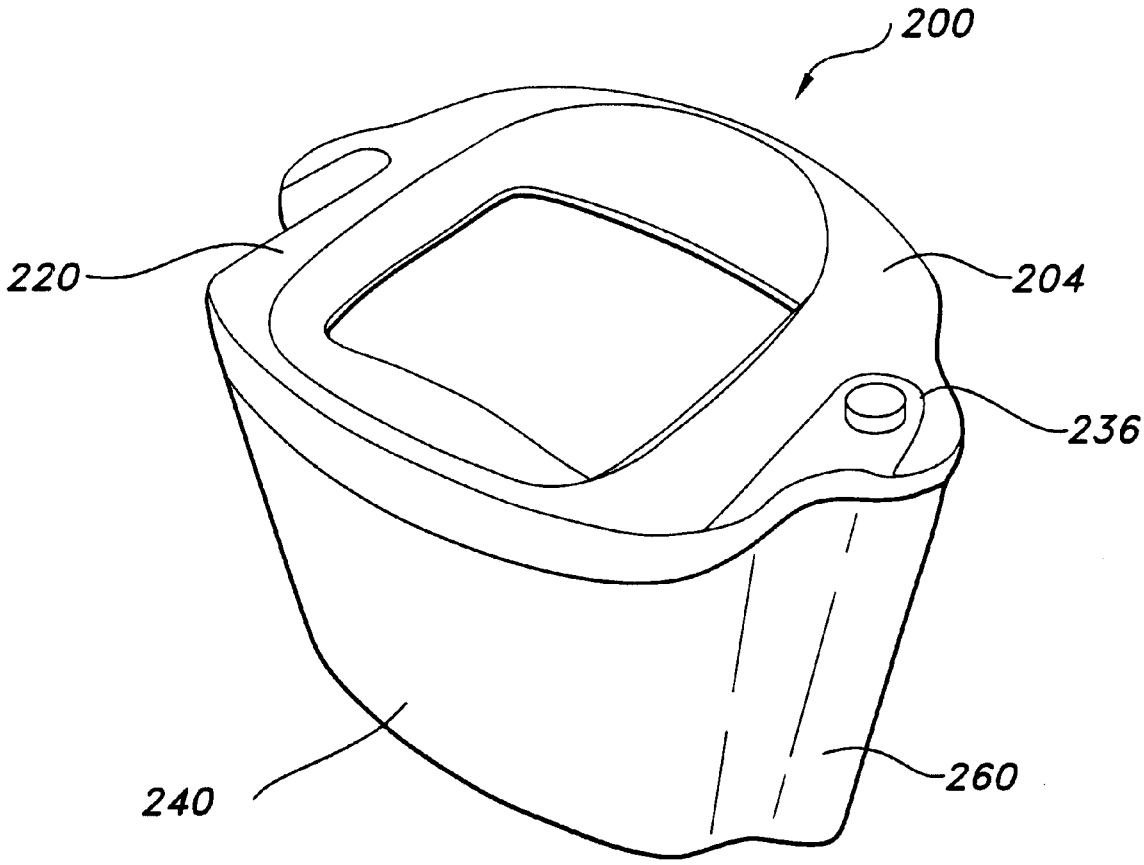

If desired, opening 232 in top surface 200 may be positioned within recess 224B so as to be defined thereby. FIG. 12 details switch 236 protruding through opening 232, thereby being accessible to a viewer. If switch 236 is a momentary pushbutton component as contemplated in FIG. 12, it may conveniently be depressed by a thumb of a viewer because of its placement within recess 224B.

Figure 13:
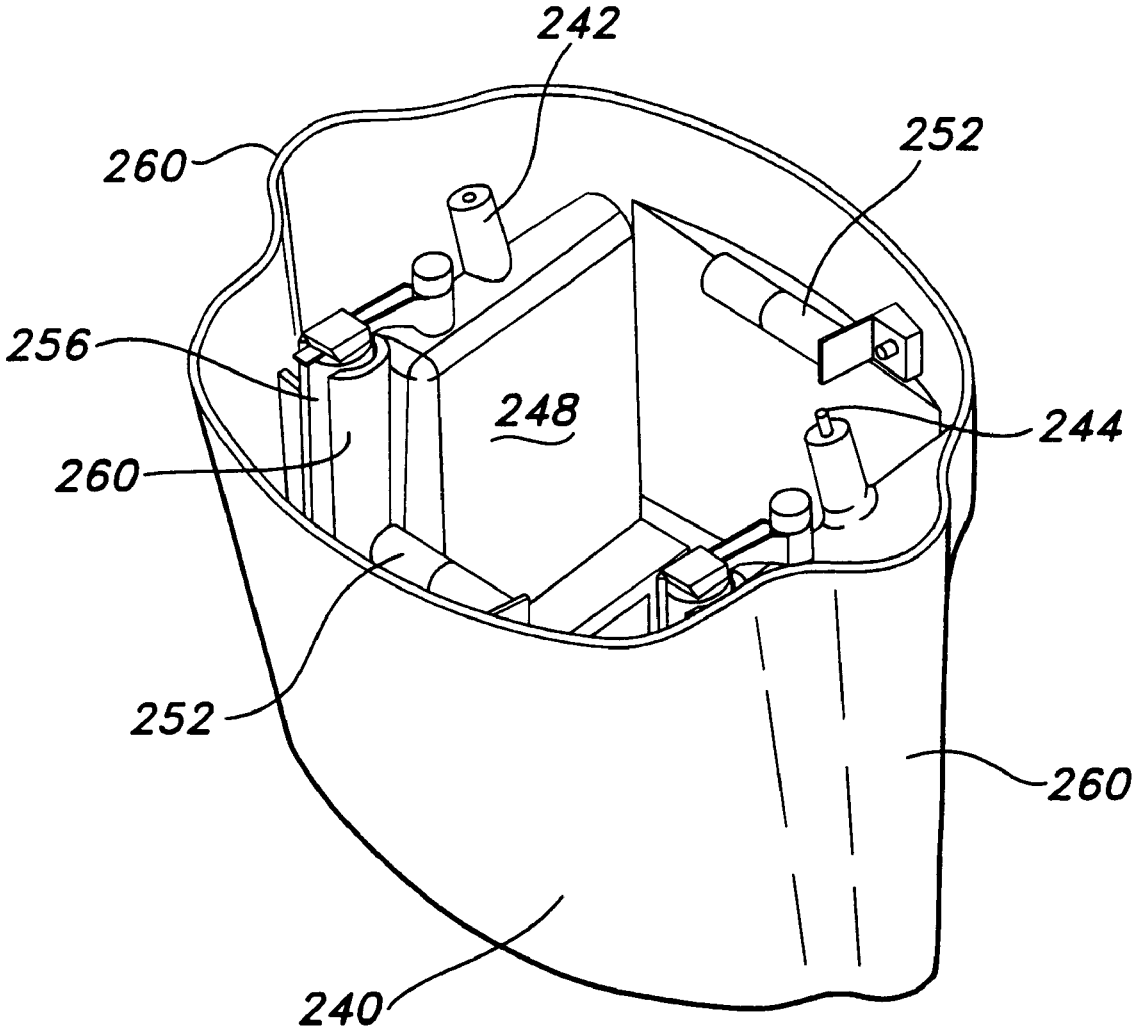

Upper portion 204 may be connected to body 240 of device 200 in any suitable manner (including being so connected by being integrally formed therewith). FIGS. 10–11 and 13 illustrate an exemplary connection mechanism, utilizing bosses 242 and corresponding screws 244 to align upper portion 204 and body 240. By aligning bosses 242 on both upper portion 204 and body 240, screws 244 (inserted from the bottom of body 240) can fasten upper portion 204 and body 240. Alternatively, upper portion 204 may be snapped into place onto body 240 and retained with an interference fit. Such fit, however, typically would need to be overcome with appropriate force so as to allow separation of upper portion 204 from body 240 and thereby permit access to the space forming interior 248 thereof.

Incorporated into body 240 may be at least one light source (such as bulbs 252) and power supply (such as batteries 256). FIG. 13 shows two such bulbs 252 mounted more or less horizontally within interior 248, underlying opposed walls 216A–B. The gently-sloping nature of walls 216A–B thus allows them to act as ledges, or lips, both reducing glare of illumination provided by bulbs 252 and redirecting some of the illumination back toward the object to be viewed. As a consequence, the object may be illuminated in some cases not only directly (by light travelling immediately downward from bulbs 252) but also indirectly (by light initially travelling upward and then redirected downward by the undersides 258 of walls 216A–B).

If body 240 has sufficient depth, batteries 256 may be positioned within interior 248 more or less vertically. Tubes or collars 260 formed as part of body 240 may be employed to retain batteries 256 so as to facilitate electrical connection thereof to bulbs 252. Apparent to those skilled in the art will be that illuminating components other than bulbs 252, and power supplies other than batteries 256, may be utilized consistent with the present invention. Such components and supplies may be located other than as shown in FIG. 13 and may be interconnected electrically in any suitable manner. In the embodiment of device 200 shown in FIG. 13, however, each bulb 252 is connected in series to at least one conventional "AA" cell used as a battery 256, so that some illumination may be provided even when one battery 256 (or set of batteries) is depleted or one bulb 252 does not function. In this case switch 236 is connected to both circuits so as to energize bulbs 252 simultaneously.

Enhanced viewing may be furnished by angling top surface 220 relative to a horizontal plane such that, if device 200 is positioned on a horizontal surface (or held parallel thereto) with wall 216A toward the rear of the device 200, the portion of top surface 220 adjacent wall 216A is further from the horizontal surface than is the portion of top surface 220 adjacent wall 216B. Body 240 additionally may have projections 260 underlying recesses 224A–B. These projections 260 may facilitate holding of device 200 by providing rests, or bearing surfaces, for a viewer's fingers. They likewise may be used as handles and grasped accordingly when device 200 is to be moved from one location to another.

Figure 14:
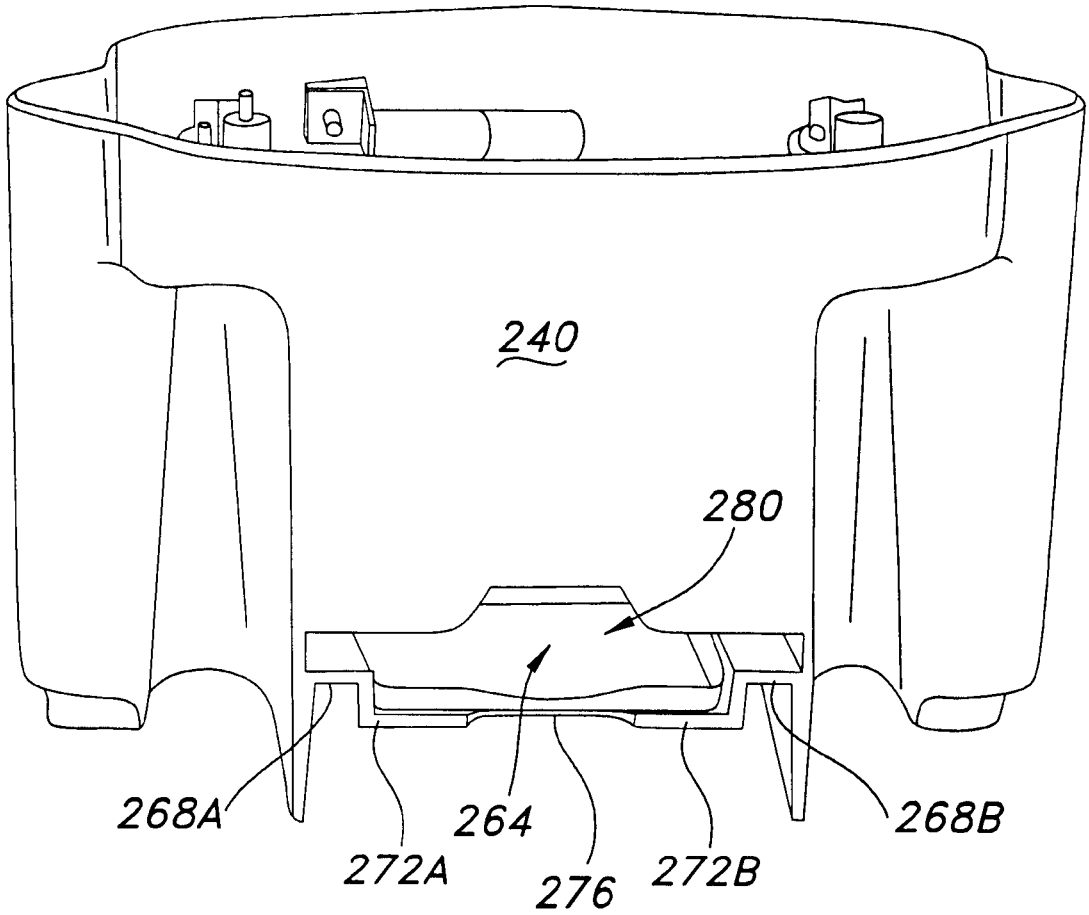

FIG. 14 illustrates opening 264 in the lower rear of body 240. Opening 264, which could be positioned elsewhere in device 200, admits entry into interior 248 of the item or object to be viewed. Opposed steps 268A–B, for example, support a typical sports or other card within interior 248 for viewing in landscape orientation, while bases 272A–B support such a card for viewing in portrait orientation. Bases 272A–B alternatively support an optional tray 276, which itself may be used to support objects otherwise inadequately directly supportable by bases 272A–B or steps 268A–B. Because some viewable objects (e.g. insects and jewelry) may have significant depth, opening 264 has greater depth in its central region 280 to permit entry of such objects into interior 248.

The foregoing is provided for purposes of illustrating, explaining, and describing embodiments of the present invention. Further modifications and adaptation to these embodiments will be apparent to those skilled in the art and may be made without departing from the scope or spirit of the invention.

What is claimed is:

1. A viewing apparatus comprising:

a body having a hollow central region bounded by four sides and a floor, with an upper side of said body having a viewing opening therein sized to allow viewing of an object in said hollow central region, and a light source located to direct light into said hollow central region, whereby said object is illuminated by light from said light source and viewable through said opening and wherein at least a portion of said floor is removable so that said object may be viewed through said body of said viewer.

2. A viewing apparatus as set forth in claim 1 wherein at least one inner surface of said sides and said floor is provided with a light absorbing surface.

3. A viewing apparatus as set forth in claim 1 further comprising a plate insertable into said hollow central region, said plate configured for holding objects for viewing through said opening.

4. A viewing apparatus as set forth in claim 1 further comprising a magnifying lens mounted in said opening for providing a magnified view of said object.

5. A viewing apparatus as set forth in claim 1 wherein at least one interior surface of said sides of said hollow central region is configured for reflecting light onto said object.

6. A viewing apparatus as set forth in claim 5 wherein said one interior surface configured for reflecting light onto said object is adjustable to reflect light through an opening in one of said sides.

7. A viewing apparatus as set forth in claim 1 wherein at least one inner surface of said sides and said floor is provided with a light reflective surface.

8. A viewing apparatus as set forth in claim 7 wherein said light reflective surface is a light scattering surface.

9. A viewing apparatus as set forth in claim 1 wherein said light source is an illumination bulb energized by an electrical power source.

10. A viewing apparatus as set forth in claim 9 wherein said electrical power source is an external power source.

11. A viewing apparatus as set forth in claim 9 wherein said body is provided with at least one hollow side, with a common wall between said hollow side and said hollow central region.

12. A viewing apparatus as set forth in claim 11 wherein said electrical power source is housed within a said hollow side.

13. A viewing apparatus as set forth in claim 11 further comprising an enclosure mounted to a said common wall, said enclosure having an opening communicating between said hollow central region and said enclosure, with said bulb mounted in said enclosure to direct light into said hollow central region.

14. A viewing apparatus as set forth in claim 13 further comprising means for holding a card such as a sports card.

15. A viewing apparatus as set forth in claim 14 wherein said means for holding a card further comprises at least one slot for receiving and holding at least one card.

16. An apparatus admitting viewing of an object, comprising:

a. a body having an interior space into which the object may be inserted for viewing;

b. an upper portion connected to the body and defining a planar opening through which the object may be viewed, the upper portion comprising a wall intersecting the plane of the opening and forming an angle of substantially greater than ninety degrees with respect thereto; and c. a light source underlying the wall and positioned within the interior space so as to illuminate the object.

17. A viewing apparatus comprising:

a body having a hollow central region bounded by four sides and a floor, with an upper side of said body having a viewing opening therein sized to allow viewing of an object in said hollow central region, the body further being provided with at least one hollow side, with a common wall between said hollow side and said hollow central region, and a light source, comprising an illumination bulb energized by an electrical power source housed within a said hollow side, located to direct light into said hollow central region, whereby said object is illuminated by light from said light source and viewable through said opening.

18. A viewing apparatus comprising:

a body having a hollow central region bounded by four sides and a floor, with an upper side of said body having a viewing opening therein sized to allow viewing of an object in said hollow central region and at least one of the four sides having an interior surface configured for reflecting light onto said object, said interior surface being adjustable to reflect light through an opening in one of said four sides, and a light source located to direct light into said hollow central region, whereby said object is illuminated by light from said light source and viewable through said opening.

* * * * *